US007935011B1

(12) United States Patent
Krbec

(10) Patent No.: US 7,935,011 B1
(45) Date of Patent: May 3, 2011

(54) RACKET HANDLE EXTENSION

(76) Inventor: Martin Krbec, Fort Collins, CO (US)

( * ) Notice: Subject to any disclaimer, the term of this patent is extended or adjusted under 35 U.S.C. 154(b) by 0 days.

(21) Appl. No.: 12/769,042

(22) Filed: Apr. 28, 2010

Related U.S. Application Data

(63) Continuation-in-part of application No. 12/006,200, filed on Dec. 31, 2007, now abandoned.

(60) Provisional application No. 60/882,861, filed on Dec. 29, 2006.

(51) Int. Cl.
*A63B 49/08* (2006.01)
*A63B 69/38* (2006.01)

(52) U.S. Cl. ..... 473/549; 473/463

(58) Field of Classification Search ..... 473/549, 473/551–553, 518, 226, 227, 459, 461, 463, 473/464

See application file for complete search history.

(56) References Cited

U.S. PATENT DOCUMENTS

| | | | | | |
|---|---|---|---|---|---|
| 2,189,997 | A * | 2/1940 | Salem | 473/461 |
| 3,188,086 | A * | 6/1965 | Parmley | 473/227 |
| 3,693,973 | A * | 9/1972 | Wattenburg | 473/463 |
| 4,595,204 | A * | 6/1986 | Patterson | 473/227 |
| 5,411,254 | A * | 5/1995 | Dressler et al. | 473/549 |
| 5,465,971 | A * | 11/1995 | Tischler | 473/227 |
| 5,531,446 | A * | 7/1996 | Scheie et al. | 473/227 |
| 5,700,205 | A * | 12/1997 | Sanford | 473/232 |
| 6,196,930 | B1 * | 3/2001 | Aumock | 473/206 |
| 7,090,588 | B2 * | 8/2006 | Bamber | 473/226 |
| 7,147,568 | B1 * | 12/2006 | Butler | 473/239 |
| 7,435,185 | B1 * | 10/2008 | Butler | 473/239 |
| 2004/0043824 | A1 * | 3/2004 | Uzelac | 473/266 |
| 2004/0048679 | A1 * | 3/2004 | Bunting | 473/226 |
| 2007/0275788 | A1 * | 11/2007 | Delpine | 473/226 |

* cited by examiner

*Primary Examiner* — Raleigh W. Chiu

(74) *Attorney, Agent, or Firm* — Kenehan & Lambertsen, Ltd.; John C. Lambertsen

(57) ABSTRACT

Assisting a player of a racket sport, such as tennis, in positional awareness of the racket head, both visually and physically, is disclosed by adding an axial extension to the racket handle, the axial extension of similar or greater length than that of the racket. Regardless of racket position, whether or not within the direct sight of the player, a visually obvious indicator located at the end of the extension permits positional awareness of the racket before, during, and after each swing. Such positional awareness can also be obtained when both the racket and visually obvious indicator at the end of the handle extension are not visible by physical contact, when any part of the handle extension touches the body indicating poor racket initial position, swing motion, or follow-through after each swing.

7 Claims, 1 Drawing Sheet

RACKET HANDLE EXTENSION

RELATED APPLICATIONS

This application is a continuation-in-part of co-pending U.S. patent application Ser. No. 12/006,200, which was filed on Dec. 31, 2007, and claims the benefit of U.S. Provisional Patent Application Ser. No. 60/882,861, filed Dec. 29, 2006; both identified applications are incorporated by reference herein for all that they contain.

TECHNICAL FIELD

The embodiments of the invention disclosed herein relate to stroke training aids and, more particularly, to stroke training aids for use in the game of tennis or like racket sports. More specifically, the present invention relates to a temporary extension placed at an end of a tennis racket to assist in maintaining proper position and orientation of a tennis racket during stroke set-up, hitting, and follow-through.

BACKGROUND ART

In my 22 years of teaching tennis, the way the students hold, set-up and swing their rackets has required constant instructor attention. Not only is racket position and movement important for beginning students; but until the highest skill level is achieved, the need for constant instruction remains. During the early stages of learning tennis, hitting the ball receives the greatest attention, while maintaining racket position or orientation that provides the best control is of secondary interest. Unless optimum technique is learned early on by the beginning student, an incorrect technique is difficult to correct.

Tennis playing skill is rated from 0.5 to 7 on NTRP rating scale. Players from the 2.5 skill level up to the 4.0 skill level need to be constantly aware of their racket position during the back swing, hitting, and the follow-through.

Teaching the correct technique for set-up, hitting and follow-through is done with verbal instruction and demonstration by teachers. Getting a student to copy the correct stance, racket position and swing depends on their ability to follow instructions and copy the instructor's movements. Different levels of success are achieved with different students.

SUMMARY OF THE INVENTION

I have invented a racket attachment which causes the racket to be held and swung in the correct orientation to rapidly gain the necessary skills commonly taught in tennis instruction. Keeping an eye on a fast moving ball is critical when playing tennis. However, being aware of the racket position, while watching and hitting the ball, is the primary skill to learn.

This attachment is an extension of the racket handle which allows the student/player to easily visualize the orientation and position of the racket when next to the body, the physical movement of the racket during the swing and its movement and position in the swing follow through. The physical handle extension provides the student/player a visual racket extension they can see with peripheral vision while keeping their eye on the ball. During the swing, the racket is out of sight until after the ball is hit. Correcting the swing by being aware of the racket movement and position after the swing is very difficult.

The racket extension clearly identifies the racket's position before, during, and after the swing. In addition, when a student uses an incorrect swing the extension or the ball at the end will make contact with the body. This can easily be felt by the student and becomes another perception method for training with this extension.

The simplest method of attaching the training extension is to affix a lightweight but strong insert inside the hollow of the handle with receptacle hole or holes which can receive and lock projecting members from the handle extension. A centrally located hole can also be threaded to receive a threaded stud projecting from the handle extension. Modern tennis rackets have a hollow handle to achieve light weight for the total racket. A short, strong lightweight insert permanently affixed inside the hollow handle will provide the simplest connection method for the handle extension.

For those players who would not want the internal hollow of their personal racket handle changed by attaching a permanent insert inside their racket handle, another attaching method will be needed. To provide a secure attachment method on the outer surface of the handle will be needed. While this training tool, will aid instructors by providing a more rapid "visual" method to learn the optimum movements of a tennis racket, the "feel" of the grip must not be changed so the player loses his rotational orientation of the racket. To minimize the change in "rib feel" thin strong metal or polymer/fiber strap can be extended up through the "V" where the handle splits to form the oval string support. A simple ratchet to tighten the strap to the racket handle can be located in the training handle extension. Sufficient tension on the strap will provide secure attachment during physically strenuous tennis shock, play and occasional dropping on the tennis court.

The tennis racket handle surface typically is composed of eight flat sides (bevels). The shape of each of the eight ridges, between the flats, provides information to the player as to the correct racket face position. External attachment of the training handle extension to the racket handle requires that any material on the outside of the handle to not unduly change the personal "feel" of handle ridges. The "feel" of these ridges must remain available to the student/player while using the training handle extension. Adding a thin strip of rubber on the connecting strap will maintain the same friction as the handle provides to the hand when using the tennis racket.

The tennis racket handle extension as a visual/physical learning guide can be made in different lengths. It can also be made with different length sections which can be connected together to provide an optimum length for height of the tennis student/player. The most direct method will be to make different length extensions with threaded receptacle inserts in one end and extension threaded studs to screw the extensions together in the other end.

The extension itself needs to be flexible to avoid breaking during rough handling while the student is learning how to use this training tool. A fiberglass or carbon fiber rod or tube such as is used in present day sports equipment will provide the required stiffness and flexibility.

A vividly colored rubber ball at the end of the extension will allow the player/student to clearly see its position and motion in his peripheral vision, while keeping his "eye on the ball". The rubber ball will also provide protection from injuries when the handle extension happens to be incorrectly used.

In accordance with aspects of embodiments of the present invention, a stroke training device for a tennis racket, comprising: a rigid handle extension attached to and axially extending from an end of a tennis racket handle, said rigid handle extension of similar or greater length to that of said tennis racket; and a visual object attached to said rigid handle extension at an end opposite a locus of attachment of said rigid handle extension to said tennis racket handle, whereby said visual object provides a physical and visual guide of the tennis racket position and orientation and wherein the handle extension and the tennis racket handle comprise a unitary construction, permitting a user unconstrained movement of the tennis racket.

In a further aspect of the present invention, a stroke trainer for a sport employing a racket, comprising: a rigid extension attached to and axially extending from an end of said racket, said rigid extension of similar or greater length to that of said racket; and a visual object attached to said rigid extension at an end opposite a locus of attachment of said rigid extension to said racket, whereby said visual object provides a physical and visual guide of the position and orientation of said racket, and wherein the extension and the racket comprise a unitary construction, permitting a user unconstrained movement of the racket.

These and various other advantages and features of the present invention are pointed out with particularity in the claims. Reference should also be had to the drawings that form a further part hereof, as well as to the accompanying descriptive matter in which are illustrated and described various examples in accordance with the invention.

BRIEF DESCRIPTION OF THE DRAWINGS

The foregoing aspects and other aspects of this disclosure are described in detail below in connection with the accompanying drawing figures in which.

DETAILED DESCRIPTION OF THE PREFERRED EMBODIMENTS

The easiest method of adjusting different length extensions is to place threaded inserts at the ends with extension threaded studs to screw any arrangement of extensions together, although this requires significant modification of the end and inside of the carbon fiber tubular handle end.

Figure 1:
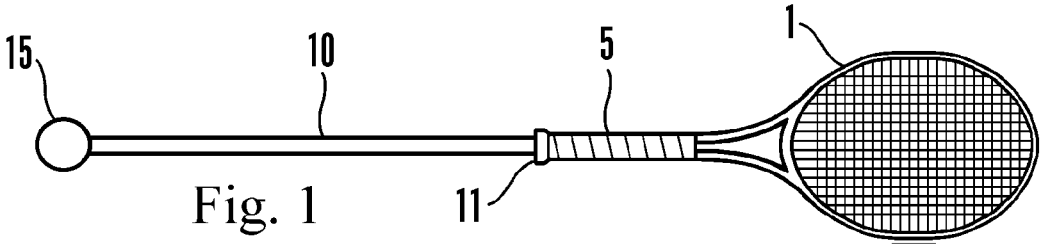
FIG. 1 is a top plan view showing a tennis racket with a handle extension.
Figure 2:
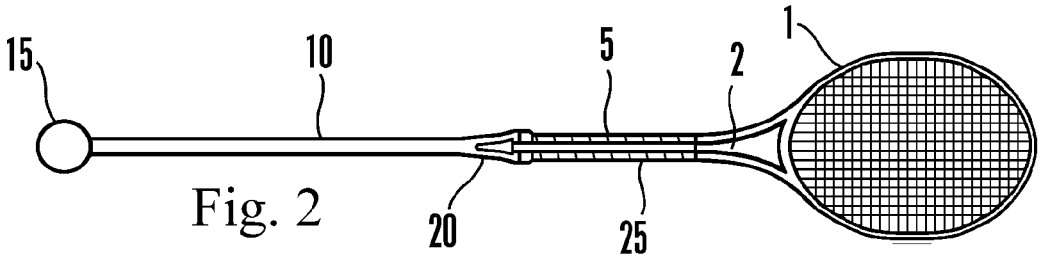
FIG. 2 is a top plan view with a portion in cross-section showing a tennis racket with a handle extension.

Reference is now made to the drawings wherein like numerals refer to like parts throughout. In FIGS. 1, and 2 the handle extension 10, is shown attached to the tennis racket 1 at the end 11, of the racket handle 5. A fiberglass or carbon fiber rod or tube such as is used in present day sports equipment will provide the required stiffness and flexibility for the handle extension 10. As is shown in the Figures, the handle extension 10 is of similar or greater length to that of the tennis racket 1.

Figure 4:
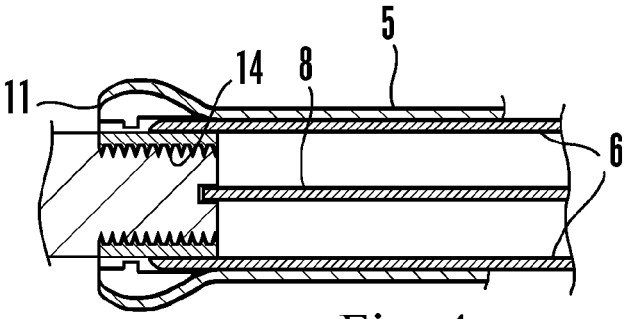
FIG. 4 is an enlarged cross-sectional view of a location of attachment of a tennis racket to a handle extension.
Figure 5:
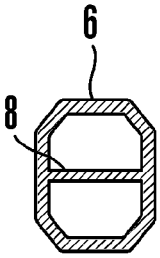
FIG. 5 is a cross-section taken along line 5-5 of FIG. 3.

The vividly colored ball 15, such as fabricated out of rubber, or other visual object, is attached at the end of the handle extension 10. In FIGS. 1 and 4 the handle extension 10 extends from the end of the handle 5 on the same axis as the handle. FIGS. 4 and 5 show a cross-section of a typical tennis racket handle made of light-weight and stiff polymer-composite carbon fiber construction. As is shown in FIG. 5, such tennis racket has a typical flattened octagonal construction having a plurality of thin walls 6, as well as including a stiffening carbon polymer composite rib 8, which when constructed extends to the end of the tubular racket handle 5.

A centrally-located threaded opening 14 can receive a threaded stud/insert 17 projecting from the handle extension 10. To affix the threaded stud/insert 17 into the handle opening 14 requires some abrasive removal of the short tapering of the tubular racket handle walls 6 to provide a relatively linear receptacle. The stud/insert 17 is permanently held in place inside the opening 14 of the racket handle 5 with a suitable adhesive. The tubular stiffening section 8 is removed for a short distance inside the handle to accommodate reception of the stud/insert 17, but can retain its stiffening effect by including adhesive to fasten it into an end slot 19 formed in the insert 17 as shown.

Figure 3:
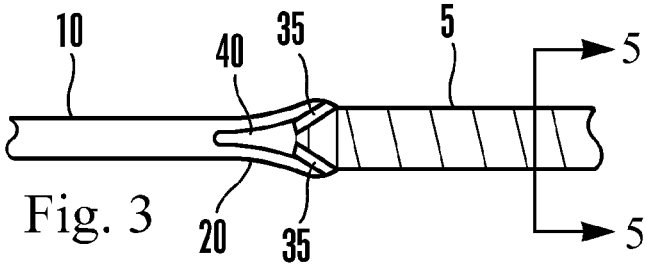
FIG. 3 is an enlarged, partial perspective view showing attachment of a tennis racket to a handle extension.

FIGS. 2 and 3, show presently preferred alternative methods of temporarily holding the handle extension training tool 10, to the end 11 of the racket handle 5.

FIG. 2 shows a thin, strong metal or polymer/fiber band 25 extending along the two wide outer flats of the handle, through the "V" groove between the handle and the tennis racket webbing, where the handle splits to form the oval string support. The band 25 is received inside a triangular opening 30 at the handle end 20 of handle extension 10. A simple ratchet or screw tightening method (not shown) having sufficient tension to tighten the band to the racket handle is preferably located inside the triangular opening 30 in the training handle extension 10.

FIG. 3 shows a less intrusive mounting of the handle extension with two strong thin straps 35 held at angles inside a more complex triangular opening 40 at the handle end 20 of the handle extension 10 designed to hold the two straps 35 in the correct orientation angles to securely hold the widened end of handle extension 10 to the wide end 11 of the racket handle 5.

My invention has been disclosed in terms of a preferred embodiment thereof, which provides a tennis practice aid that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A stroke training device for a tennis racket, comprising:

a rigid handle extension attached to and axially extending from an end of a tennis racket handle, said rigid handle extension of similar or greater length to that of said tennis racket; and a visual object attached to said rigid handle extension at an end opposite a locus of attachment of said rigid handle extension to said tennis racket handle, whereby said visual object provides a physical and visual guide of the tennis racket position and orientation and wherein the handle extension and the tennis racket handle comprise a unitary construction, permitting a user unconstrained movement of the tennis racket.

2. A stroke training device according to claim 1, wherein said rigid handle extension is attached to a surface of said tennis racket handle in a removable manner, such that any increase in a diameter of said tennis racket handle is minimized and such that said handle extension is selectively removable, permitting said handle extension to be removed for play in a game of ordinary tennis.

3. A stroke training device according to claim 2, wherein said handle extension is removably attached to an outer terminus of said tennis racket handle.

4. A stroke training device according to claim 2, wherein said handle extension is removably attached to an insert rigidly mounted within said tennis racket handle in a manner maintaining an alignment with an axis of said tennis racket handle.

5. A stroke training device according to claim 4, wherein said handle extension is provided a male threaded stud extending from a first end of said handle extension and a female threaded opening is formed in said outer terminus of said tennis racket handle, whereby said threaded stud is removably received in a rigid manner within said female threaded opening.

6. A stroke training device according to claim 1, wherein the handle extension is permanently attached to said tennis racket handle for training unrestrained, free-swinging learning use.

7. A stroke trainer for a sport employing a racket, comprising:

a rigid extension attached to and axially extending from an end of said racket, said rigid extension of similar or greater length to that of said racket; and a visual object attached to said rigid extension at an end opposite a locus of attachment of said rigid extension to said racket, whereby said visual object provides a physical and visual guide of the position and orientation of said racket, and wherein the extension and the racket comprise a unitary construction, permitting a user unconstrained movement of the racket.

* * * * *